United States Patent [19]

Hemsher

[11] 4,278,966

[45] Jul. 14, 1981

[54] VISUAL SIGNALING SYSTEM

[75] Inventor: Frank J. Hemsher, Venetia, Pa.

[73] Assignee: Control Technology, Inc., McMurray, Pa.

[21] Appl. No.: 10,701

[22] Filed: Feb. 9, 1979

[51] Int. Cl.[3] ..... G08B 5/36

[52] U.S. Cl. ..... 340/366 R; 340/43; 340/381

[58] Field of Search ..... 340/43, 381, 332, 366 R

[56] References Cited

U.S. PATENT DOCUMENTS

| | | | |
|---|---|---|---|
| 889,533 | 6/1908 | Maas | 340/309.4 UX |
| 1,759,918 | 5/1930 | Schwartz | 340/309.1 UX |
| 2,127,887 | 8/1938 | Rayburn | 340/381 UX |
| 2,190,035 | 2/1940 | Loungway | 340/43 |
| 2,194,614 | 3/1940 | Rayburn | 340/381 UX |
| 2,291,610 | 8/1942 | Crane | 340/366 R UX |
| 2,313,560 | 3/1943 | Levine | 340/328 UX |
| 2,348,431 | 5/1944 | Warmey | 340/332 |
| 2,396,971 | 3/1946 | Rucker | 340/43 |
| 2,553,482 | 5/1951 | Smith | 340/309.1 UX |
| 2,843,845 | 7/1958 | Vozza | 340/332 |
| 2,963,692 | 12/1960 | Barter | 340/251 |
| 2,967,298 | 1/1961 | Riggins | 340/381 |
| 3,529,287 | 9/1970 | Southerland | 340/43 |
| 3,810,170 | 5/1974 | Zinmeister | 340/420 |

*Primary Examiner*—Harold I. Pitts

*Attorney, Agent, or Firm*—Robert D. Yeager; Andrew J. Cornelius

[57] ABSTRACT

A visual signaling system including at least two light sources. Graphic indicators positioned adjacent to the light sources for identifying the light sources. The indicators including codes for identifying a particular light source with which it is associated and permitting one to distinguish one light source from another relying on the code.

The indicator, in one form of the invention, may consist of a band positioned adjacent to the light source with the code being the extent of shading of the band. In one form of the invention, a circular band is provided with discrete levels of shading corresponding to particular light sources. The system may be a warning or alarm system with the extent of shading being a function of the relative importance of the particular light source.

9 Claims, 2 Drawing Figures

| CODE | COLOR | OFF | FLASHING | ON |
|---|---|---|---|---|
| 6, 4 | GREEN | OFF PROOF | | ON PROOF |
| 12, 8, 10 | YELLOW | NO WARNING | WARNING | |
| 20, 16, 18 | ORANGE | NO ALARM | AUDIBLE ALARM | ALARM ACKNOWLEDGE |
| 24, 22 | RED | NO ALARM | AUDIBLE ALARM & INITIATE CORRECTIVE ACTION | ALARM ACKNOWLEDGE |

VISUAL SIGNALING SYSTEM

BACKGROUND OF THE INVENTION

1. Field of the Invention

This invention relates to visual signaling systems and, more specifically, it relates to visual means for assisting one with accurately identifying an illuminated light source.

2. Description of the Prior Art

In connection with numerous types of systems, it has been known to provide visual and/or audible displays which communicate information to individuals. In industrial environments such systems frequently appear on a control system panel and they serve to provide indications of desired or undesired operating conditions. With respect to the latter, it is frequently desirable, and in many instances, critical that the warning or alarm information be disseminated in a fail-safe fashion so as to avoid an undesired condition or misinterpretation. As the information provided by such systems is frequently not only of great consequence in respect of efficiency of operation of an industrial installation, but also can represent potentially disastrous situations which threaten both life and property, it is critical that efficiency of communication be maintained.

It has been known, in various environments, to employ light and an audible indication simultaneously as a means of communicating desired information. See, for example, U.S. Pat. Nos. 1,759,918, 2,313,560 and 2,553,482.

It has also been known to provide a visual signaling system wherein the color of the light illuminated is relied upon to assist with distinguishing different messages. See for example, U.S. Pat. No. 3,810,170. It has also been known to rely on the position of the light illuminated as well as the color of the same to provide the desired information. See, for example, U.S. Pat. Nos. 2,127,887, 2,194,614, 2,291,610 and 3,529,287.

As, even with individuals of normal physical and mental capabilities, one is likely to be in an anxious state when exposed to a warning or alarm situation, it is essential that every effort be made to avoid confusion or misunderstanding regarding the nature of the condition or problem. In addition, with the passage of time, society is becoming more and more concerned about the welfare of handicapped individuals and the benefits to both such individuals and society of maximizing their abilities to lead normal lives including the opportunity to be gainfully employed. It will be appreciated, however, that an individual who is afflicted with color blindness would have great difficulty functioning in an environment where color differences would be the basis for distinguishing between different alarm or warning states. Similarly, an individual who is hard of hearing would have difficulty determining from an audible indication that a particular emergency state existed.

There remains, therefore, a very real need for improved visual signaling systems which will serve to minimize the likelihood of an individual either being unaware that a warning or alarm state exists or, in the alternative, an individual obtaining the wrong message.

SUMMARY OF THE INVENTION

The present invention has solved the above described problems by providing a visual signaling system wherein at least two light sources are employed. In general, each light source will be associated with one or more colored lenses. Graphic indicator means are positioned adjacent to the light sources for identifying the light sources. The indicator means include code means for identifying the particular light source with which it is associated. In a preferred embodiment of the invention, bands are provided in surrounding relationship with the light sources and the code means consist of the extent of shading of the band means. The extent of shading is preferably in direct relationship to the relative importance of the monitored light source function.

The band means may take the form of a substantially circular band with the shadings falling within the ranges of 0 to 360 degrees. The shading is preferably provided in a substantially permanent form which is visible regardless of whether or not the associated light source is illuminated. In order to maximize the ease with which one light source may be distinguished from another on the basis of the circular indicator means, it is preferred that the shading between two adjacent bands be no less than about 45 degrees different from each other.

It is an object of this invention to provide a visual signaling system which is adapted to provide improved communication of visually presented information.

It is another object of this invention to provide such a visual signaling system which is adapted to efficiently communicate warning or alarm states to people who are afflicted with visual and/or hearing difficulties.

It is a further object of this invention to provide such a system which is compatible with existing warning or alarm systems.

It is a further object of the present invention to provide such a system which is economical to adopt and easy for those employing it to master the system.

These and other objects of the invention will be more fully understood from the following description of the invention on reference to the illustrations appended hereto.

DESCRIPTION OF THE PREFERRED EMBODIMENTS

Figures 1, 2:
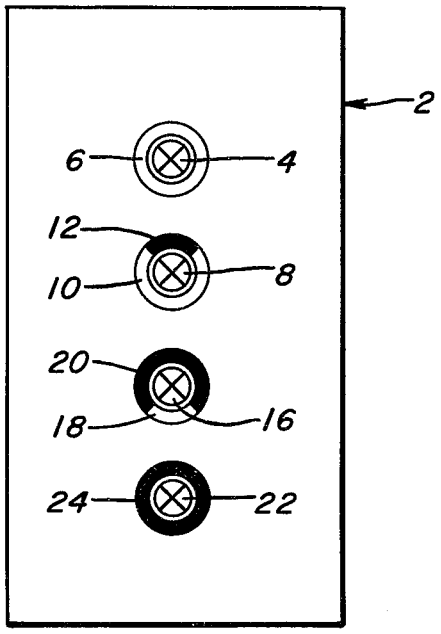
FIG. 1 is a partially schematic illustration of a visual signaling system of the present invention employing four light sources.
FIG. 2 is a somewhat schematic code chart showing a form of explanation of the system of FIG. 1.

The term "shading" as used herein shall include not only a solid shaded or darkened portion of a geometric shape, but also (a) portions of a geometric shape of one or more contrasting colors with respect to the rest of the geometric shape, (b) other graphic means of providing a ready visual distinction between one portion of a geometric shape and other portions thereof, (c) portions of a graphic display which are readily visually distinguishable from other portions thereof and/or adjacent areas regardless of whether the portions are disposed within a geometric shape or other border or not (d) any combinations of (a) through (c), and (e) functional equivalents of (a) through (d).

While for convenience of reference and clarity of description, reference will be made herein to both "light source" and "lens", it will be appreciated that the light source will generally consist of a lamp (not shown in the drawings) over which is placed a lens through which the light passes.

Referring now more specifically to FIG. 1, there is shown a panel 2 which may take the form of any sort of display panel which bears a visual communication system. In a preferred form of this invention this system will be employed in connection with a control system such as an industrial control system. In addition, while for purposes of convenience of reference, primary emphasis will be placed upon a system which would normally under the prior art be placing primary reliance on color of lens to distinguish one alarm or warning light source state from another, it will be appreciated that this system may incorporate an audible alarm system in addition to the visual display systems. If desired, one or more light sources or lenses therefor may be of the same color as another light source or lens. Also, in such systems the light may be operated in a flashing mode or low intensity glowing mode, if desired. The audible alarm may operate either cyclically or continuously.

In general, in order to be advantageous, the invention of the present system requires the presence of at least two light sources. It will be appreciated, however, that substantially more will generally be employed. For convenience of reference herein, a system employing four distinct light sources will be described.

As is shown in FIG. 1, each light source is covered by a colored lens 4, 8, 16, 22. Under prior art systems these lenses 4, 8, 16, 22 would generally each be of a different color so as to facilitate distinguishing one alarm or warning state from another. For purposes of example herein, the lens 4 will be considered as being green, lens 8 will be yellow, lens 16 will be orange and lens 22 will be red. In the present invention graphic indicator means are positioned adjacent to the light sources for facilitating identifying particular light sources. In the form shown in FIG. 1, the indicator means consists of generally circular bands 6, 10, 18, 24 which surround the light sources and lenses 4, 8, 16, 22, respectively. These bands may be affixed by any desired means so as to be substantially permanent. For example, they may advantageously be provided by painting, decals, engraved plates or separate attached washer-like members. Also, if desired the bands could be provided on the periphery of the lens.

In order to facilitate distinguishing one light source from another, the indicator means are provided with code means. The code means, in the preferred form of the invention, consists of a dark shading of the bands. In this fashion a code is established which enables an individual to look at the particular band and identify the particular light source and, as a result, the alarm or warning message. For example, it is noted that lens 4 is associated with the totally unshaded band 6. Lens 8 is associated with band 10 which is shaded over a 90 degree region. Lens 16 is associated with band 18 which is shaded over a 270 degree region and lens 22 is associated with totally shaded band 24. In addition to or in liue of coding the extent of shading with respect to the color of the lens, as in the form illustrated, the code may be established in such fashion that increased shading corresponds to more serious warning or alarm situations.

Referring now to FIG. 2 it is seen that a chart is provided correlating the code with the function. For example, lens 4 is of green color and band 6 is totally unshaded. This indicates merely whether the particular physical system with which the visual signaling system is associated is in an "off" state or an "on" state when the light source behind lens 4 is on in continuous fashion. With respect to yellow lens 8, the band 10 is shaded over a 90 degree region. A flashing light source behind lens 8 indicates a warning state. With respect to orange lens 16 which is associated with band 18 which is shaded over approximately 270 degrees, a flashing state will be coupled with an audible alarm indicating an alarm condition when an acknowledgment button (not shown) is pushed, the audible alarm will be turned off and the flashing light source will be in a steady on condition indicating that the alarm warning has been acknowledged. Finally, in connection with red lens 22 which is surrounded by totally shaded band 24, a flashing light will produce an audible alarm and automatically initiate corrective action. When the acknowledge button has been pressed, the light source behind lens 22 will stay on constantly confirming that the alarm state has been acknowledged.

It will, therefore, be appreciated that one need merely look at the indicating means surrounding the lens to determine the colored light, specific status, warning or alarm condition and the relative seriousness thereof. It will be appreciated that in the form shown a substantially circular band has been provided around each light source with the extent of shading falling within the range of 0 to 360 degrees. It will be appreciated that for systems employing more than four light sources intermediate shadings differing from those illustrated with four may be employed. For example, the light source covered by a blue lens to be interposed between the yellow and orange, the shading might be provided about 180 degrees. In general, in order to maintain clear lines of demarcation between the respective code means, it is preferred that the degree of shading between adjacent light sources be a minimum of about 45 degrees with the preferred minimum being about 60 degrees.

While for purposes of convenience of reference herein a substantially circular preferred geometric shape has been illustrated, it will be appreciated that the indicating means may advantageously be provided in other geometric shapes such as rectangular, triangular or other polygonal shapes. While for convenience of reference herein, the expressions "band" and "bands" have been employed to refer to a geometric shape or the like having meaningful radial width, it will be appreciated that the graphic indicator means positioned adjacent to the light source may take the form of a line which is of sufficient thickness as to be visible and such a line is contemplated as being included within the term "band" and the term "bands" as used herein. Also, while the preferred form contemplates the use of a band which is illustrated as having been shaded for a certain number of degrees about the center of the lens, it will be appreciated that a closed geometric shape need not be provided, in all instances, but rather only the extent of the shaded portion may be illustrated. In the context of the example provided in the drawings, the green would be indicated by merely a radially oriented line, the yellow would be indicated by a shaded band covering about 90 degrees, the orange would be indicated by 270 degree band and the red would be indicated by a closed circular band.

While for purposes of simplicity of illustration, a preferred embodiment employing solid shading has been shown, the invention is not so limited. For example, a series of lines, dots or other graphic symbols may be provided as the indicator means, with or without a surrounding geometric border, with the code means being the relative density of lines, dots, etc. adjacent the light sources serving as the basis for distinguishing one light source from another and/or for indicating relative importance. For example, four light sources may each be surrounded by rectangles of equal size. The first rectangle may be unlined, the second rectangle may have five lines, the third rectangle may have eleven lines and the fourth rectangle may have twenty-three lines.

It will be appreciated that while the present invention may advantageously and preferably be employed in industrial and commercial environments for use on a wide variety of industrial equipment controls including manufacturing or processing equipment as well as industrial and commercial heating, ventilating and air conditioning system controls, other uses will be apparent to those skilled in the art.

It will be appreciated, therefore, that the present invention provides a visual signaling system which facilitates improved efficiency of communication to the individuals not having physical or mental incapacities and greatly facilitates use by certain individuals having visual and/or auditory impairments. All of this is accomplished in an economical fashion which is consistent with existing systems.

Whereas particular embodiments of the invention have been described abve for purposes of illustation it will be evident to those skilled in the art that numerous variations of the details may be madewithout departing from the invention as defined in the appended claims.

I claim:

1. A visual signaling system comprising p1 at least two light sources, graphic indicator means operatively associated with said light sources for identifying said light sources, said indicator means including bands surrounding said light sources, said indicator means being substantially continuously and simultaneously visible, and said indicator means having code means for identifying the particular light source with which it is associated, said code means including shading of said bands to an extent corresponding to the specific light source with which it is associated, whereby said indicator means will permit one to distinguish one of said light sources from another of said light sources.

2. The visual signaling system of claim 1 including said bands being substantially circular and said shading falling within the range of 0–360 degrees.

3. The visual signaling system of claim 1 wherein said light sources each have a colored lens, and the extent of said shading corresponds to the color of the lens with which it is associated.

4. The visual signaling system of claim 3 wherein k the system is a warning or alarm system, and said shading being so coded that bands of greater shading have greater relative importance.

5. The visual signaling system of claim 3 wherein said shading is present in readily visible fashion regardless of whether the light source with which it is associated is illuminated.

6. The visual signaling system of claim 5 wherein said shading is effected in increments such that no two bands will be closer than about 45 degrees to each other.

7. The visual signaling system of claim 1 wherein said bonds are substantially rectangular.

8. The visual signaling system of claim 3 wherein each said colored lens is of a different color.

9. A visual signaling system comprising:

at least two light sources, graphic indicator means operatively associated with said light sources for identifying said light sources, said indicator means including a closed geometric shape surrounding said light sources, said indicator means being substantially continuously and simultaneously visible, and said indicator means having code means for identifying the particular light source with which it is associated, said code means including shading of said shapes to an extent corresponding to the specific light source with which it is associated, whereby said indicator means will permit one to distinguish one of said light sources from another of said light sources.

* * * * *

UNITED STATES PATENT AND TRADEMARK OFFICE

CERTIFICATE OF CORRECTION

PATENT NO. : 4,278,966

DATED : July 14, 1981

INVENTOR(S) : Frank J. Hemsher

It is certified that error appears in the above-identified patent and that said Letters Patent are hereby corrected as shown below:

Col. 5, line 32, delete "pl";

Col. 6, line 11, delete "k"; and

Col. 6, line 24, delete "bonds" and substitute therefor --bands--.

Signed and Sealed this

*Twenty-second* Day of *September 1981*

[SEAL]

*Attest:*

GERALD J. MOSSINGHOFF

*Attesting Officer*

*Commissioner of Patents and Trademarks*